US006201852B1

(12) United States Patent
Goddu et al.

(10) Patent No.: US 6,201,852 B1
(45) Date of Patent: Mar. 13, 2001

(54) METHOD AND MEANS FOR VARIABLY ATTENUATING RADIATION

(75) Inventors: Sreekrishna Murty Goddu, Kearny; Roger W. Howell, Millington; Dandamudi V. Rao, Basking Ridge, all of NJ (US)

(73) Assignee: University of Medicine & Denistry of New Jersey, Piscataway, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/840,144

(22) Filed: Apr. 11, 1997

(51) Int. Cl.[7] ..... G21K 3/00
(52) U.S. Cl. ..... 378/159; 378/156
(58) Field of Search ..... 378/156–159

(56) References Cited

U.S. PATENT DOCUMENTS 3,755,672 8/1973 Edholm et al. .
4,446,570 5/1984 Guth .
4,481,419 11/1984 Persyk .
4,497,062 1/1985 Mistretta et al. .
5,148,465 9/1992 Mulder et al. .
5,559,853 9/1996 Linders et al. .

*Primary Examiner*—Craig E. Church
(74) *Attorney, Agent, or Firm*—Klauber & Jackson

(57) ABSTRACT

A variable attenuation apparatus for use with a radiation-blocking liquid and a radiation source having an attenuation chamber capable of containing a layer of the radiation-blocking liquid and an adjustment device for selectively metering the thickness of the layer of the radiation-blocking liquid, whereby changes in the thickness of the layer alter the radiation transmitted through the attenuation chamber. In one embodiment, an adjustment device includes a reservoir for holding the radiation-blocking liquid and a siphon connection device for allowing the transfer of the radiation-blocking liquid between the reservoir and the attenuation chamber, wherein the thickness of the layer in the attenuation chamber varies in response to changes in elevation of said reservoir, so that an increase in the thickness of the layer causes a drop in the radiation transmitted through the attenuation chamber. A substantially linear increase in the thickness of the layer in the attenuation chamber may yield a substantially exponential drop in the radiation dose rate transmitted through the attenuation chamber. A desired dose rate pattern, such as an exponential dose rate pattern, may be delivered by the apparatus. An adjustable irradiator system is presented, and a method for delivering varying temporal radiation dose rates is described.

36 Claims, 6 Drawing Sheets

METHOD AND MEANS FOR VARIABLY ATTENUATING RADIATION

BACKGROUND OF THE INVENTION

The present invention relates to irradiation systems, generally and, more particularly, but not by way of limitation, to methods and means of variably attenuating radiation.

When radionuclides are administered for diagnostic purposes in nuclear medicine, the absorbed doses received by the critical organs and tissues of the target are usually sufficiently low that the biological effects cannot be measured with any reliability. In these instances, reliance solely on calculated absorbed doses may be appropriate and sufficient for risk estimations and comparison of the relative merits of different radiopharmaceuticals. However, when radionuclides are administered for therapeutic purposes, or in cases involving accidental ingestion of high levels of radioactivity, dependence on untested absorbed dose calculations can lead to serious errors in predicting the biological consequence of the radiation exposure. Such concerns are particularly relevant to complex biological systems, such as the bone marrow. For example, computational bone marrow dosimetry techniques used in radioimmunotherapy have failed to yield a reasonable correlation between absorbed dose and biological response of the marrow. The shortcomings and failures of existing techniques may include, among others, the following reasons: the underlying assumptions in the absorbed dose calculations; differences in dose rate patterns; prior treatment history and bone marrow reserve; and nonuniform activity distributions in the marrow compartment. These problems are not unique to bone marrow, but can also exist for other organs and tissue as well. Hence, in view of the limitations inherent in computational dosimetry, a need exists for reliable biological dosimeters to verify the computational methods.

It is well known that the biological effect of a given radiation insult is highly dependent on factors such as total absorbed dose, dose rate, linear energy transfer (LET) of the radiations, and radiosensitivity of the tissue. See: ICRP, *RBE for Deterministic Effects,* Publication 58, International Commission on Radiological Protection, Pergamon, Oxford (1989); and ICRP, 1990 *Recommendations,* Publication 60, International Commission on Radiological Protections, Pergamon, Oxford (1991); both of which are incorporated by reference herein in their entirety. While the consequences of these variables are well established for acute and constant chronic radiation exposure conditions, little is known about the role of these variables for exposures involving internal radionuclides. Also see: Testa, et al., *Biomedicine,* 19:183–186 (1973); Wu, et al., *Int. J. Radiat. Biol.,* 27:41–50 (1975); and Thames, et al., *Br. J. Cancer,* 49, Suppl. VI:263–269 (1984); all of which are incorporated by reference herein in their entirety.

Internal radionuclides are unique in that they deliver radiation exposures at dose rates that vary exponentially in time as determined by the effective half-time, which in turn is dictated by the physical half-life of the radionuclide and the biological half-time of the radiochemical. Further complications to the dose rate pattern can emerge when the uptake of the radiochemical by the tissue is slow, followed by a complex multicomponent exponential clearance pattern. Although the total dose delivered to a tissue may be the same, differences in dose rate patterns from one radiochemical to another can have a major impact on the biological response of the tissue. See: Fowler, *Int. J Radiat. Oncol. Biol. Phys.,* 18:1261–1269 (1990); Langmuir, et al., *Med. Phys.,* 20, Pt. 2:601–610 (1993); Rao, et al., *J. Nucl. Med.,* 34:1801–1810 (1993); and Howell, et al., *J. Nucl. Med.,* 35:1861–1869 (1994); all of which are incorporated by reference herein in their entirety. Such differences cannot always be predicted a priori using computational absorbed dose estimates and extrapolations based on the response to acute and chronic exposure at constant dose rates. Therefore it is imperative to develop experimental irradiators that are capable of precisely delivering exposure that simulate the conditions encountered with internal radionuclides and to establish biological endpoints that can serve as "dosimeters" so that the consequence of different dose rate patterns on the biological effect can be investigated.

Two endpoints which may serve as biological dosimeters are survival of bone marrow granulocyte-macrophage colony-forming cells (GM-CFC) and induction of micronuclei in peripheral blood reticulocytes. See: Testa, *Cell Clones: Manual of Mammalian Cell Techniques,* Edinburgh: Churchill-Livingstone, 27–43 (1985); and Lenarczyk, et al., *Mutation Res.,* 335:229–234 (1995); both of which are incorporated by reference herein in their entirety.

DESCRIPTION OF THE RELATED ART

U.S. Pat. No. 5,148,463 issued to Mulder et al. discloses an X-ray filter which is lens-like and filled with a liquid whereby variations in the thickness of the liquid provides varying amounts of attenuation for image compensation. The filter thickness is adjustable by the supply and the discharge of the liquid. Fluid is supplied to or withdrawn from the filter by a pump until a uniform radiation image is achieved. It should be noted that Mulder et al. fails to disclose selectively metering the attenuation or delivery of radiation, and also fails to disclose adjustment of the radiation achieved by a siphon effect.

U.S. Pat. No. 4,481,419 issued to Persyk discloses the attenuation of radiation with a changeable volume of mercury disposed within a reservoir. A radiation transmitting housing includes a fluid chamber and means for selectively adjusting the shape of the fluid chamber as to vary the configuration of the radiation pattern. However, the fluid chamber is wedge-shaped and the adjusting means varies the internal angle of the wedge. A reservoir cavity is incorporated into the fluid chamber, but the reservoir is provided to accommodate changes in the volume of fluid material needed to feed the wedge portion and that due to fluid temperature changes. Radiation is attenuated by thickness of the fluid material. A fluid chamber is preferably filled with mercury, then sealed. However, once adjusted and set, the fluid chamber can not be varied. It should be noted that Persyk fails to disclose selectively metering the attenuation or delivery of radiation, and also fails to disclose adjustment of the radiation achieved by a siphon effect.

U.S. Pat. No. 3,755,627 issued to Edholm et al. discloses the use of a mercury attenuator for providing image compensation. The compensating filter device includes a radiation absorbing medium consisting of a liquid enclosed in a thin flat chamber, wherein the radiation absorbing liquid may be mercury or some other liquid metal or solution or stable suspension of a radiation absorbing substance, such as an aqueous solution of cesium acetate. The flat chamber has an upper wall consisting of a resiliently flexible diaphragm whose contour is adjusted by a polarity of wires attached to the diaphragm. The thickness of the liquid layer follows the contour of the flexible diaphragm. It should be noted that Edholm et al. fails to disclose selectively metering the attenuation or delivery of radiation, and also fails to disclose adjustment of the radiation achieved by a siphon effect.

U.S. Pat. No. 4,446,570 issued to Guth discloses a radiation collimator which includes internal cavities which are filled with radiation opaque fluid, such as mercury. The fluid fills the spaces between the pins within a toroidal-shaped chamber, thereby providing a vertical multi-channel parallel collimator which serves as a mask for outlining the field of view of the radiation detector. A toroidal recess which forms a raised ring around the periphery of the upper internal surface functions as an expansion chamber to accommodate changes in volume of the mercury due to changes in temperature. Fluid is introduced into the cavities, and the chamber is sealed. The introduction of fluid can be assisted by evacuating the cavities, such as by a vacuum pump. It should be noted that Guth fails to disclose selectively metering the attenuation or delivery of radiation, and also fails to disclose adjustment of the radiation achieved by a siphon effect.

U.S. Pat. No. 4,497,062 issued to Mistretta et al. discloses a digitally controlled X-ray attenuator and a method for its use in which a control responsive ink-jet printer prints pixels containing various proportions of attenuation substances in order to form compensation masks for X-ray imaging. It should be noted that Mistretta et al. fails to disclose selectively metering the attenuation or delivery of radiation, and also fails to disclose adjustment of the radiation achieved by a siphon effect.

U.S. Pat. No. 5,559,853 issued to Linders et al. discloses an X-ray filter in which electrodes in a matrix are selectively energized in order to distribute X-ray absorption particles, electrophoretically, in a compensation filter. The filter has a number of electrodes and grains or powder particles containing an X-ray absorbing material and suspended in a suspension liquid. When a voltage is applied to the electrodes, the X-ray absorbing material and the suspension will move toward the electrodes due to electrophoresis, and a distribution corresponding to a X-ray absorption profile can be achieved by a suitable voltage pattern. It should be noted that Linders et al. fails to disclose selectively metering the attenuation or delivery of radiation, and also fails to disclose adjustment of the radiation achieved by a siphon effect.

OBJECTS AND SUMMARY OF THE INVENTION

It is an object of the present invention to provide method and means of attenuating radiation. It is another object of the present invention to provide a method and means of attenuating radiation in a highly controlled or selectively metered manner. It is still another object of the present invention to provide a method and means of delivering radiation according to user defined input or input parameters or pre-selected schedules. It is yet another object of the present invention to provide a method and means capable of attenuating radiation in a temporally variable manner. It is another object of the present invention to provide a method and means for delivering radiation exposures at dose rates that vary exponentially in time. It is yet another object of the present invention to provide a means of delivering radiation exposure. It is a further object of the present invention to provide a means of delivering radiation exposure which simulates conditions encountered with internal radionuclides. It is still another object of the present invention to provide a method and means of attenuating radiation by controlling the level of a radiation-blocking liquid layer by siphon effect.

Another object of the present invention is to provide a method and means to investigate the biological response of bone marrow to chronic exponentially decreasing dose rates encountered in therapy with bone-seeking radiochemicals having different effective half-lives, and hence different dose rate patterns.

It is another object of the present invention to provide a method and means of verifying absorbed dose calculations.

It is yet another object of the present invention to provide a method and means of determining how the biological effects caused by complex dose rate patterns correlate with variables such as initial dose rate, effective half-times, and other factors associated with radiation dosing.

It is yet another object of the present invention to provide a method and means of calibrating biological dosimeters.

Other objects of the present invention, as well as particular features, elements, and advantages thereof, will be elucidated in, or be apparent from, the following description and the accompanying drawing figures.

The present invention achieves the above objects, among others, by providing, a method and means for variably attenuating radiation The present invention provides, in a particular embodiment, a variable attenuation apparatus for use with a radiation-blocking liquid and a radiation source. The apparatus includes an attenuation chamber capable of containing a layer of the radiation-blocking liquid and an adjustment means for selectively metering the thickness of the layer of the radiation-blocking liquid, whereby changes in the thickness of the layer alter the radiation transmitted through the attenuation chamber.

The adjustment means may further include a reservoir capable of containing the radiation-blocking liquid and a siphon connection means for allowing the transfer of the radiation-blocking liquid between the reservoir and the attenuation chamber, wherein the thickness of the layer in the attenuation chamber is a function of the difference in elevation between the top of the layer in the attenuation chamber and the top of the liquid in the reservoir, whereby an increase in the thickness of the layer causes a drop in the radiation transmitted through the attenuation chamber.

In a particular embodiment, a substantially linear increase in the thickness of the layer in the attenuation chamber yields a substantially exponential drop in the radiation dose rate transmitted through the attenuation chamber.

Preferably, the elevation of the attenuation chamber is substantially fixed and the reservoir is vertically moveable, whereby changes in the radiation dose rate transmitted through the attenuation chamber are a function of changes of the elevation of the reservoir.

The adjustment means further preferably includes a control means for controlling the movement of the reservoir, thereby providing control of the radiation transmitted through the attenuation chamber. The control means may further preferably include means for maintaining at least a minimum liquid thickness in the reservoir, and means for preventing the level of the liquid in the reservoir from rising above a maximum liquid height. Moreover, the control means may include means for specifying a desired dose rate pattern, such as an exponential dose rate pattern.

The adjustment means further preferably includes a movable support means for supporting the reservoir and for adjusting the elevation of the reservoir relative to the attenuation chamber, such as a platform and drive means for vertically moving the platform. The drive means may include a shaft connected to the platform, a stepper motor connected to the shaft, and a stepper motor control means for receiving instructions from the control means and for sending motor control signals to the stepper motor.

Preferably, the radiation-blocking liquid is liquid mercury.

The apparatus further preferably includes a mutual vent means connecting the attenuation chamber and reservoir above respective maximum liquid levels for allowing an equalization of gas pressure therebetween.

Furthermore, the present invention achieves the above objects, among others, by providing, in a particular embodiment, a method for delivering varying temporal radiation dose rates using an adjustable irradiator system, the system comprising a radiation source, a reservoir containing a radiation-blocking liquid, and an attenuation chamber connected to the reservoir by a siphon coupling and disposed in front of the radiation source, the method including selectively adjusting the elevation of the reservoir relative to the attenuation chamber and allowing the radiation-blocking liquid to seek a common level in the attenuation chamber and in the reservoir, thereby selectively adjusting the thickness of the radiation-blocking liquid in the attenuation chamber, whereby changes in the radiation dose rate transmitted through the attenuation chamber are a function of changes in the thickness of the radiation-blocking liquid in the attenuation chamber. The system is thus capable of administering a metered dose of radiation.

The method further preferably includes selectively adjusting the elevation of the reservoir to cause an exponential rate of change in the radiation transmitted through the attenuation chamber.

Preferably, a substantially constant rate of change in the level of the liquid in the reservoir causes a substantially constant rate of change in the level of the liquid in the attenuation chamber. Moreover, a substantially linear change in the thickness of the layer preferably causes a substantially exponential change in the radiation dose rate transmitted through the attenuation chamber.

The method may also include maintaining a minimum liquid thickness in the attenuation chamber. The method may further include preventing the level of the liquid in the attenuation chamber from rising above a maximum liquid level.

The present invention comprises a radiation attenuation apparatus and method which allows adjustment of the level of the radiation blocking liquid in finite increments thereby allowing the use of radiation-blocking fluids having the ability to attenuate high levels of radiation at a minimal fluid thickness. Such an apparatus and method allow for the attenuation means to be used in environments where a small-sized attenuator means is required.

Furthermore, the present invention achieves the above objects, among others, by providing, in a particular embodiment, an adjustable irradiator system for use with a radiation-blocking liquid, the system including a radiation source and a variable attenuator means for intercepting at least a portion of the radiation emitted from the radiation source and for selectively blocking at least a part of the intercepted radiation with the radiation-blocking liquid, wherein the variable attenuator means is capable of transmitting at least another part of the intercepted radiation. The system is preferably capable of delivering exponentially varying temporal radiation dose rates. The variable attenuator means further preferably includes an attenuation chamber containing a layer of the radiation-blocking liquid and an adjustment means for adjusting the thickness of the layer, whereby changes in the thickness of the layer alter the radiation transmitted through the attenuation chamber. The system is thus capable of administering a metered dose of radiation.

The system may also include a target means having at least one target station capable of receiving radiation transmitted through the attenuation chamber. The distance between the target station and the attenuation chamber may be adjustable.

Furthermore, the target means may include a plurality of spaced apart target stations, wherein each station is disposed a different respective distance away from the attenuation chamber, whereby the target stations are capable of simultaneously receiving different respective radiation rates from the attenuation chamber.

BRIEF DESCRIPTION OF THE DRAWINGS

Understanding of the present invention and the various aspects thereof will be facilitated by reference to the accompanying drawing figures, submitted for purposes of illustration only and not intended to limit the scope of the invention, in which.

DETAILED DESCRIPTION OF THE PREFERRED EMBODIMENTS

Figure 1:
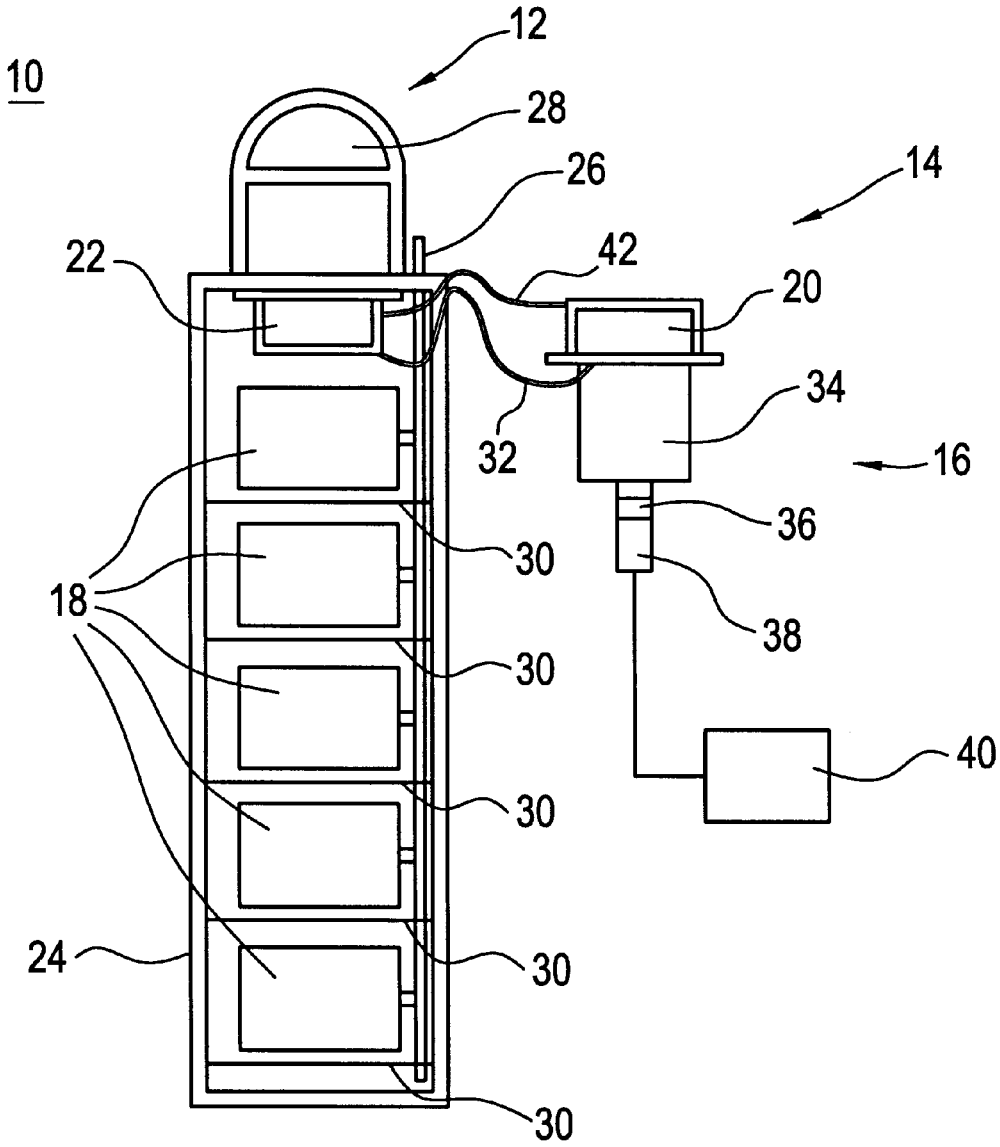
FIG. 1 is a schematic of an irradiator system including a $^{137}$Cs irradiator and a mercury attenuator system according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may also be seen on other views.

The present invention provides an apparatus for use with a radiation-blocking liquid and a radiation source. The apparatus includes an attenuation chamber capable of containing a layer of the radiation-blocking liquid, wherein the attenuation chamber is disposed to intercept at least a portion of the radiation emitted from the radiation source, and an adjustment means for selectively metering the thickness of the radiation-blocking liquid layer. Changes in the thickness of the layer alter the amount of radiation transmitted through the attenuation chamber, thereby selectively attenuating at least part of the intercepted radiation.

The adjustment means may further include a reservoir capable of containing the radiation-blocking liquid and a siphon connection means for allowing transfer of the radiation-blocking liquid between the reservoir and the attenuation chamber. The thickness of the layer in the attenuation chamber varies in response to changes in elevation of the reservoir. Changes in the thickness of the layer are preferably directly proportional to changes in elevation of the reservoir. More particularly, the thickness of the liquid layer in the attenuation chamber is a function of the difference in elevation between the bottom of the attenuation chamber and the top of the liquid in the reservoir. An increase in the thickness of the liquid layer causes a drop in the radiation transmitted through the attenuation chamber. In a particular embodiment, the adjustment means may further include a pump means, which is preferably automatically controlled, for assisting the flow in the siphon connection means.

In a particular embodiment, a substantially linear increase in the thickness of the liquid layer in the attenuation chamber yields a substantially exponential drop in the radiation dose rate transmitted through the attenuation chamber.

Preferably, the elevation of the attenuation chamber is substantially fixed and the reservoir is vertically moveable, whereby changes in the radiation dose rate transmitted through the attenuation chamber are a function of changes in the elevation of the reservoir.

The adjustment means preferably includes a control means for controlling the movement of the reservoir, thereby providing control of the amount of transmitted radiation, the dose as well as the dose rate of the radiation transmitted through the attenuation chamber may be selectively controlled. The control means may further include means for maintaining at least a minimum liquid thickness in the reservoir, and additionally, means for preventing the liquid level in the reservoir from rising above a maximum liquid height.

Preferably, the control means includes a means for specifying a desired dose rate pattern, such as a one-, two-, or three-component exponential dose rate pattern, or another does rate pattern.

The adjustment means further preferably includes a movable support means for supporting the reservoir and for adjusting the elevation of the reservoir relative to the attenuation chamber. The movable support means may include a platform and drive means for vertically moving the platform. The reservoir may be attached to the platform by one or more z-axis brackets.

A particular embodiment of the drive means includes a shaft connected to the platform, a stepper motor connected to the shaft, and a stepper motor control means for receiving instructions from the control means and for sending motor control signals to the stepper motor. The movable support means would then preferably include a gear reduction means connecting the stepper motor to the shaft. The gear reduction means may comprise a planetary gearbox, for example, a planetary gearbox having an approximate 100 to 1 gear reduction ratio. The shaft may comprise a lead screw.

Preferably, the radiation-blocking liquid layer is liquid mercury. Mercury is known to effectively attenuate radiation, so that small changes in the thickness of a layer of liquid mercury may result in a relatively large increment in attenuation. Furthermore, the thickness of the attenuating liquid, as well as changes thereto, may be minimized. Accordingly, the siphon means is at least partially fabricated from a material exhibiting a substantial lack of reactivity with mercury, such as PVC. The siphon means enables very precise control over the metering of the mercury. Other suitable radiation-blocking or radiation absorbing or radiation opaque liquids may also be used, such as another liquid metal or solution or stable suspension of a radiation absorbing or blocking substance, such as an aqueous solution of cesium acetate. When such other suitable radiation-blocking liquids are used, the siphon means is preferably at least partially fabricated from materials exhibiting a substantial lack of reactivity to the radiation-blocking fluid utilized. Such other radiation-blocking fluids and materials which do not substantially react therewith are known in the art.

Further preferably, the attenuation chamber and the reservoir are liquid-tight and airtight in order to fully contain the radiation-blocking liquid and any vapors or gases associated therewith.

The apparatus may further include a mutual vent means connecting the attenuation chamber and reservoir above respective maximum liquid levels for allowing an equalization of gas pressure therebetween. The mutual vent means may include a vent tube. In a particular embodiment, the vent tube connects the top of the attenuation chamber with the top of the reservoir means.

The present invention also contemplates an adjustable irradiator system for use with a radiation-blocking liquid. The system includes a radiation source and a variable attenuator means for intercepting at least a portion of the radiation emitted from the radiation source and for selectively blocking at least a part of the intercepted radiation with the radiation-blocking liquid, wherein the variable attenuator means is capable of transmitting at least a second part of the radiation intercepted from the radiation source. The system is capable of administering a metered dose or dose rate of radiation. Preferably, the system is capable of delivering exponentially varying temporal radiation dose rates.

The system preferably includes a target means having at least one target station capable of receiving radiation transmitted through the attenuation chamber. The distance between the target station and the attenuation chamber is preferably adjustable. Thus, the system may include a plurality of spaced apart target stations, wherein each station is disposed a different respective distance away from the attenuation chamber, whereby the target stations are capable of simultaneously receiving different respective radiation rates through the attenuation chamber. The present invention further contemplates, in a particular embodiment, a method for delivering varying temporal radiation dose rates using an adjustable irradiator system, the system comprising a radiation source, a reservoir containing a radiation-blocking liquid, and an attenuation chamber connected to the reservoir by a siphon coupling and disposed in front of the radiation source. Preferably the radiation dose rates are temporally varied exponentially. The method includes the steps of selectively adjusting the elevation of the reservoir relative to the attenuation chamber and allowing the radiation-blocking liquid to seek a common level in the attenuation chamber and in the reservoir. The thickness of the radiation-blocking liquid in the attenuation chamber is thereby selectively adjustable, and changes in the radiation dose rate transmitted through the attenuation chamber are a function of changes in the thickness of the radiation-blocking liquid in the attenuation chamber. In at least one embodiment, a substantially constant rate of change in the liquid level in the reservoir causes a substantially constant rate of change in the liquid level in the attenuation chamber, thereby causing an exponential rate of change in the radiation transmitted or delivered through the attenuation chamber. Thus, an increase in the thickness of the liquid layer in the attenuation chamber causes a decrease in the radiation dose rate transmitted through the attenuation chamber.

The method preferably includes exponentially temporally varying the radiation dose rates. A substantially linear change in the thickness of the liquid layer preferably causes a substantially exponential change in the radiation dose rate transmitted through the attenuation chamber.

The method may also include maintaining a minimum liquid thickness in the attenuation chamber. The method may also include preventing the level of the liquid in the attenuation chamber from rising above a maximum liquid level.

FIGS. 1–4 correspond to a first preferred embodiment of an irradiator system 10 according to the present invention. As seen in FIG. 1, a $^{137}$Cs-irradiator 12 is coupled to a computer controlled variable attenuator 14. The system 10 was designed and constructed to irradiate small animals chronically with dose rate patterns that exactly match those delivered by internal radiochemicals.

A first preferred embodiment of the irradiator system 10 has three major components: a $^{137}$Cs irradiator 12, an attenuator 14, and a motion control system 16. The irradiator 12 delivers low dose rates of $^{137}$Cs gamma rays (0.01–30 cGy/h) to animal cages 18 housed below the irradiator 12. The attenuator 14 affords precise control of the dose rate by introducing a layer of highly absorbing mercury between the irradiator 12 and the cages 18. The liquid properties of mercury allow siphoning of the material between a reservoir 20 outside the irradiator 12 and an attenuation chamber 22 mounted between the irradiator 12 and the cages 18. The motion control system 16 is used to raise the reservoir 20 to add mercury to the attenuator chamber 22 (i.e. decrease dose rate) and lower the reservoir 20 to remove mercury from the attenuator chamber 22 (i.e. increase dose rate). The computer-controlled motion control system 16 automatically raises and lowers the mercury reservoir 20 to achieve the desired temporal dose rate pattern.

In the first embodiment, a low-dose-rate $^{137}$Cs-irradiator 12 was custom designed for the purpose of chronic irradiation of small animals. A self-contained cabinet-like Model JL-28-8 irradiator (inner dimensions 48"×9"×13") as constructed by J. L. Shepherd and Associates (San Fernando, Calif.) was utilized.

FIG. 1 shows the interior of irradiator cabinet 24, defining a radiation chamber, with mouse cages 18. The mercury attenuator chamber 22 is just above the top cage 18 and just below the $^{137}$Cs source 12. The water lines 26 for the mouse cages 18 can be seen on the right side. The cages 18 could be placed within the cabinet 24 and irradiated simultaneously, each cage 18 receiving a different dose rate.

The irradiator 12 housed an 18 Ci $^{137}$Cs source 28 which provided a beam of 662 keV gamma rays. The beam was passed through a beam shaper to provide a uniform field. Field uniformity at a distance of 20 cm from the beam port is ±6% over a 6"×6" area. The dimensions of the isodose plane increase as the distance from the beam port is increased. Shelves 30 (¼" Lucite®) were located within the irradiator system 10 to hold animal cages 18 at different distances below the source 28, thereby providing different dose rates to each cage 18. The source-to-cage distances were capable of being varied, as desired, in ¼" increments. The irradiator system 10 was also fitted with a day-night timed light, six-outlet flexible water supply line 26, and a ventilation system to continuously replace the air in the cabinet 24. In addition, the irradiator system 10 had an electronic interlock system to prevent opening of the door during periods of irradiation.

In order to simulate exponentially decreasing dose rates, an irradiator system 10 was built using the JL-28-8 irradiator 12.

The attenuator system 14 included two air-tight cambers, viz. a mercury reservoir 20 and an attenuation chamber 22. The reservoir 20 and attenuation chamber 22 were constructed of ½" thick clear polyvinyl chloride (CPVC). Holes were drilled and tapped in the bottom of each chamber 20, 22 and ⅛" nylon NPT elbow fittings inserted. The two chambers 20, 22 were connected with Nalgene™ reinforced PVC tubing 32 (3⁄16" ID) to allow transfer of mercury therebetween. To prevent buildup of air pressure in the chambers 20, 22, an additional NPT fitting was inserted into the side of each chamber and connected with Nalgene™ reinforced PVC tubing to serve as a vent. PVC was chosen for its lack of reactivity with mercury. The attenuator chamber 22 was bolted to the inside of the irradiator cabinet 24 between the irradiator 12 and the animal cages 18 and shelves 30, whereas the reservoir 20 was fixed on a computer controlled platform 34. In the absence of air in the mercury transfer line 32, the mercury thickness in the attenuation chamber 22 depends on the vertical position of the mercury reservoir 20. Mercury has a linear attenuation coefficient of about 1.49 $cm^{-1}$ for the 662 keV gamma rays of $^{137}$Cs. Therefore, a 4 cm thick layer of mercury can attenuate the beam by a factor of about 200. A linear increase in the mercury thickness yields an exponential drop in the dose rate to each animal cage 18. Therefore, a constant flow rate of mercury into the attenuator chamber 22 provides an exponentially decreasing dose-rate to each cage 18 in the irradiator cabinet 24, the half-time of the decrease in dose-rate being determined by the flow rate of the mercury. Similarly, a constant flow rate out of the attenuator chamber 22 gives an exponentially increasing dose rate. Each cage location in the irradiator receives a different initial dose-rate depending on the distance from the $^{137}$Cs source 28, although the dose-rates in all of the cages 18 vary with the same half-time. If a multicomponent exponential change in the dose-rate is desired, the flow rate of the mercury can be automatically altered using the motion control system 16 described below to accommodate the half-time of each component. Finally, the hard limit switches of the Daedal cross-roller table 34 (described below) were set to ensure a minimum mercury thickness of at least 4 mm in the attenuator chamber 22, which was the minimum thickness required to cover the entire bottom of the chamber 22, and a maximum of mercury thickness of 40 mm to prevent overflow into the vent tube.

The vertical position of the mercury reservoir 20 was automatically controlled using a motorized cross-roller table 34. The motorized table 34 included a Daedal (Harrison City, Pa.) Model 106061 C cross-roller table fitted with a Model 04M lead screw (0.4 mm/revolution) and Model 4990-06 z-axis brackets, a Bayside (Port Washington, N.Y.) Model PG60 planetary gearbox 36 with 100:1 ratio, and a Compumotor (Rohnert Park, Calif.) Model 567-102-MO stepper motor 38. The stepper motor 38 was controlled with a Compumotor Zeta series drive (Model 83-135) and a Compumotor AT6200 two-axis stepper controller housed in a Gateway 2000 386SX/20C computer 40. The entire motion control system 16 was powered through an American Power Conversion (APC) Back-UPS 1250 uninterruptable power supply. This high precision system 16, which utilized a 0.4 mm/revolution lead screw and 100:1 gearbox, was capable of changing the mercury thickness in the attenuator 22 by only 2 $\mu$m per revolution of the stepper motor 38.

In this particular embodiment, software was written in Borland TurboPascal 4.0 to control the motion of the mercury reservoir 20 via computer to provide the desired dose rate pattern, and to execute the planned motion by sending Compumotor 6000 Series commands to the motor 38. The software code accommodated one-, two-, or three-component exponential dose-rate patterns having the forms described below.

For a single component exponential, which is capable of being described by the following equation:

$$r=r_o e^{-0.693t/Td}, \quad (1)$$

the code requires input of the decrease half-time $T_d$, i. e. the time required for the dose rate to decrease to one-half its value, ) and the initial dose rate $r_o$ required for cage position 1. As used herein, $T_i$ represents the half-time for dose-rate increase.

A two-component exponential dose rate pattern, where there is an initial period of increasing dose rate followed by a period of decreasing dose rate, is capable of being described by the following equation:

$$r=r_o(e^{-0.693t/Td}-e^{-0.693t/Ti}). \quad (2)$$

In this case, the code requires the extrapolated initial dose rate $r_o$ (12), the increase half-time $T_i$ (time required for dose rate to increase from zero to one-half of $r_o$), and the decrease half-time $T_d$.

Finally, for a three-component pattern that simulates an increase phase and two decrease phases, the dose rate is capable of being described by the following equation:

$$r=r_o\{(ae^{-0.693t/Td1}+(1-a)e^{-0.693t/Td2})-e^{-0.693t/Ti}\}. \quad (3)$$

The extrapolated initial dose rate $r_o$, the increase half-time $T_i$, and the decrease half-times $T_{d1}$ and $T_{d2}$, as well as the parameter a are required for the code.

It should be understood that in addition to the above dose rate profiles (Eqs. 1–3), the code could be modified to accommodate any dose rate pattern, wherein the user may input desired values, or levels, or parameters, or patterns into the control means 40 so as to effect a precisely controlled attenuation of radiation, resulting in a metered radiation dose or dose rate. It should be further understood that the level of radiation blocking liquid in the attenuation chamber may be maintained at discrete or fixed levels for extended periods of time. Thus, the present invention provides a method and means for automatically administering a time-varying or temporally varying dose of radiation. The automated radiation delivery can help reduce the potential for human error. It should be understood that the present invention may comprise a control means which includes accepting user input commands corresponding to a manual override, wherein a preset temporal pattern may be interrupted by, or substituted with, real time manual commands.

A Thomson-Nielson Model TN-RD-50 MOSFET dosimeter system was used to measure the absorbed dose-rate at each cage position in the radiation chamber of the cabinet 24 as a function of mercury thickness in the mercury attenuator chamber 22. The MOSFET dosimeters and bias power supply were factory customized to allow measurements at low dose-rates (<1 cGy/h) and low doses (as low as 2 cGy). Low doses could be measured with an accuracy of about 10%, whereas the accuracy of higher doses (>10 cGy) is within 5%. Dose rates were measured with the probes attached to mouse phantoms placed in the 9"×6"×6" polycarbonate animals cages 18 (with bedding and wire cage tops). The dosimeter system was also used to monitor the total absorbed dose received by each cage 18 of animals during exposures involving varying dose rates.

A mutual vent means 42 which connects the attenuation chamber 22 and the reservoir 20 is preferably provided above respective maximum liquid levels. Thus the vent means 42 allows an equalization of gas pressure between the reservoir 20 and the attenuation chamber 22, thereby facilitating the flow of attenuating liquid therebetween. Furthermore, the vent means 42 allows the system to run as a closed system. For example, if mercury were used as the attenuating liquid, both the liquid and gas or vapor phase of the mercury would be contained substantially within the system, thereby reducing the potential of any unintentional contact with the mercury, whether by the operator, the test subjects or others.

In operation, a control means or computer 40 direct stepper motor 38 to turn planetary gear box 36, which thereby raises or lowers table 34. The reservoir 20 thus is raised or lowered to adjust the level of mercury inside the reservoir 20 with respect to the level of mercury residing in the attenuator chamber 22. The layer of mercury in the attenuator chamber 22 attenuates or filters at least part of the radiation emanating from the source 28 of the irradiator 12. Radiation dosages or dose rates incident upon objects or specimens within the irradiator cabinet 24, such as in animal cages 18 or on shelves 30, may be carefully controlled, and in particular, temporally controlled.

It should be understood that the present invention is capable of delivering differential doses over a desired period of time. Any time-dosage pattern may be entered into the system. For example, a test subject or patient may be exposed to a high dosage for ten minutes, then to substantially no radiation for three hours, then to two-minute dosages at low levels every hour for six hours.

Furthermore, the system 10 may include a sensor means for detecting and/or recording the radiation dosage and/or dosage rate incident upon a given location. The sensor means may be used to track the amount of radiation received by an object or subject, and may also serve as a safety mechanism to prevent over or under exposure to the incident radiation. The sensor means may further be connected to the control means 40, wherein the signal or signals received from the sensor means may be utilized as a feedback signal in control scheme which controls the motion of the reservoir 20, and hence the level of radiation-blocking liquid in the attenuation chamber. Thus, the radiation dosage or dose rate may be adjusted according to a preset pattern which may be further controlled by a real-time feedback control scheme.

Figure 2:
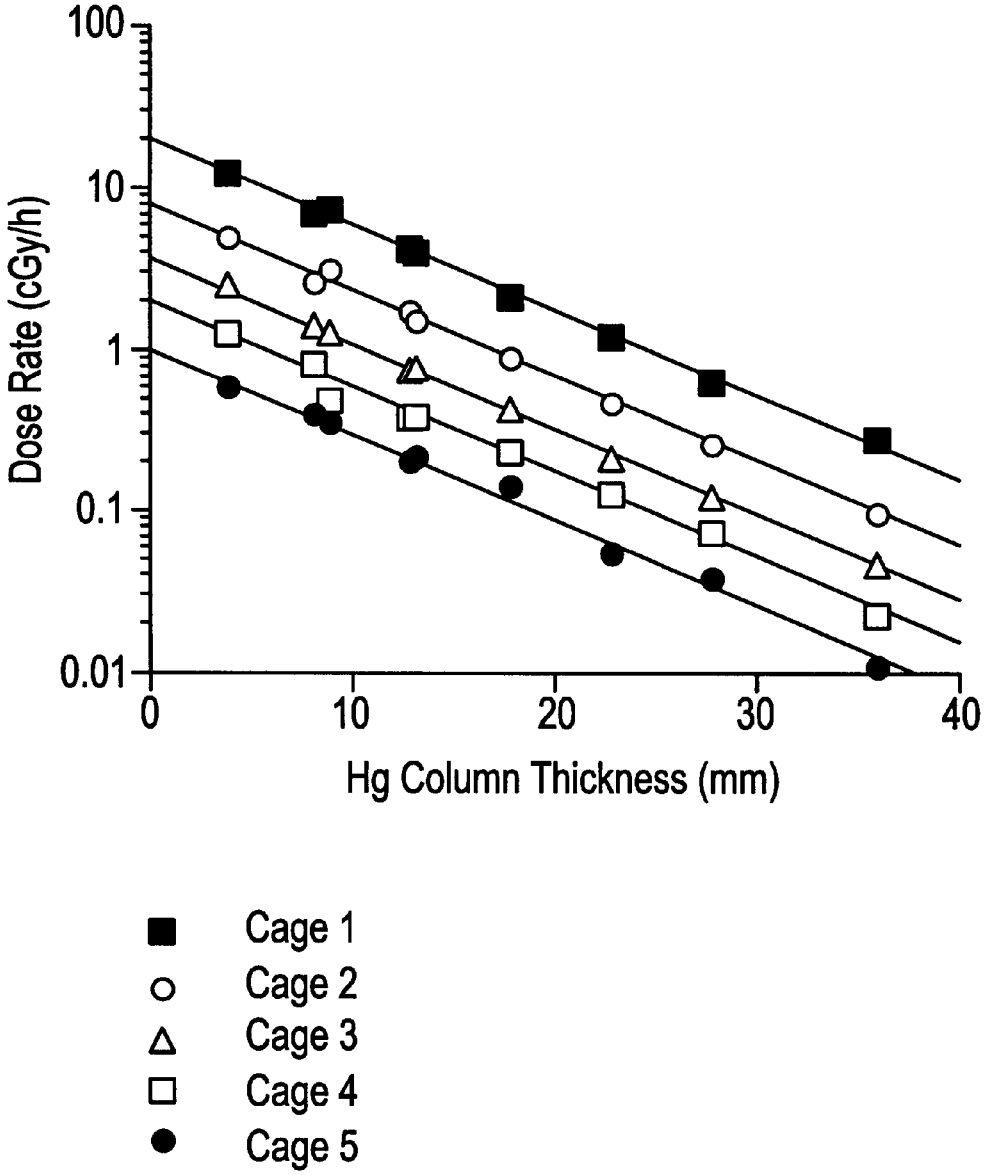
FIG. 2 shows the dose rate in mouse phantoms located in Cage 1 (28.6 cm from top of chamber), Cage 2 (48.9 cm), Cage 3 (68.9 cm), Cage 4 (88.9 cm), and Cage 5 (108.6 cm), as a function of mercury thickness in the attenuator chamber.

FIG. 2 illustrates the dose rate as a function of mercury thickness in the attenuator chamber 22 for each cage position. The dose rate was exponentially dependent on the mercury thickness. Least squares fits of the experimental data for each cage position yielded a mean linear attenuation coefficient of 1.22±0.02 $cm^{-1}$, which represents the mean slope and standard deviation of the curves shown in FIG. 2. For a mercury density of 13.546 $g/cm^3$, the mass attenuation coefficient was calculated to be 0.089 $cm^2/g$. This value is comparable to the Hubbell's theoretical value for mercury of 0.11 $cm^2/g$ for 662 keV photons. See Hubbell, *Int. J. Appl.*

*Radiat. Isot.,* 33:1269–1290 (1982), which is incorporated by reference herein in its entirety.

FIG. 2 also shows that the dose rate changed by a factor of about 20 from the top cage to the bottom cage regardless of the mercury thickness of the attenuator chamber 22. Hence, depending on the cage location and the mercury thickness in the attenuator chamber 22, dose rates from 0.01 cGy/h to 12 cGy/h can be delivered. Furthermore, the maximum dose rate can be increased to as high as about 30 cGy/h simply by using low-profile (5 cm in height instead of the standard cage height of 15 cm) animal cages 18 which allow the cages to be placed closer to the $^{137}$Cs source 28.

To demonstrate the capabilities of the irradiator system 10, a two-component exponential dose rate pattern, corresponding to Equation 2 above, was simulated using a 1 h increase half-time, a 12 h decrease half-time, and an extrapolated initial dose rate $r_o$ of 6.0 cGy/h.

Figure 3:
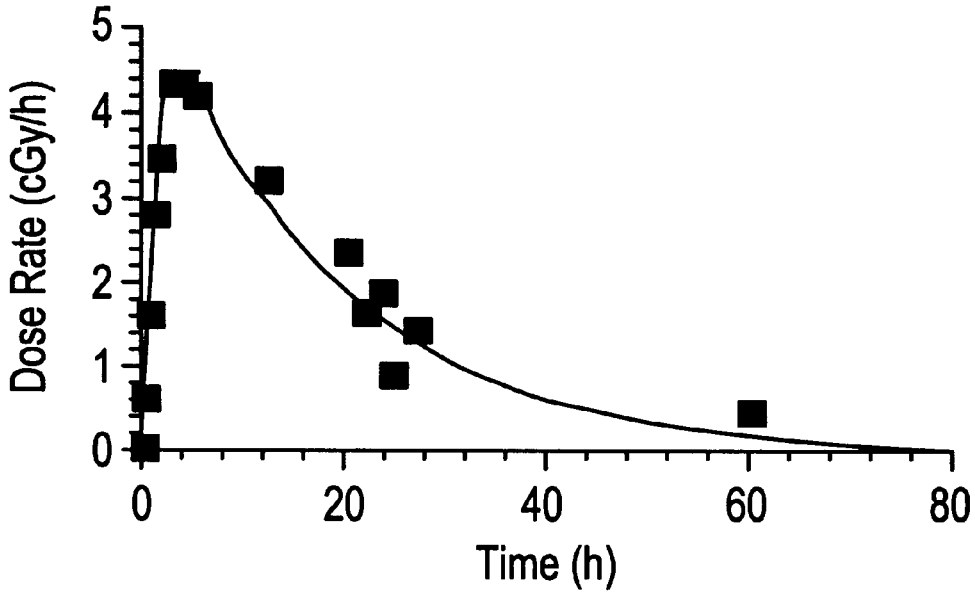
FIG. 3 shows the dose rate as a function of time during an irradiation that simulates a two-component exponential dose-rate pattern with a single increase phase ($T_i$=1 h) and a single decrease phase ($T_d$=12 h), wherein the extrapolated initial dose rate was set to 6.0 cGy/h, and the expected dose rate pattern is represented by the solid line, whereas the experimentally determined dose rates are indicated with solid squares.

FIG. 3 shows the resulting experimental dose rate measurements along with the expected dose rate pattern based on Equation 2, revealing good agreement between the experimental and expected dose rates.

The data presented in FIGS. 2 and 3 show that the system 10 is capable of delivering dose rate patterns that are similar to those observed in therapeutic nuclear medicine. Given the strong dependence of biological response on dose rate, such an irradiator system 10 is an invaluable tool to assess the biological effects of exponentially varying dose rates on any given target tissue, which is a largely unexplored area of considerable importance to radioimmunotherapy and other targeted therapies.

Figure 4:
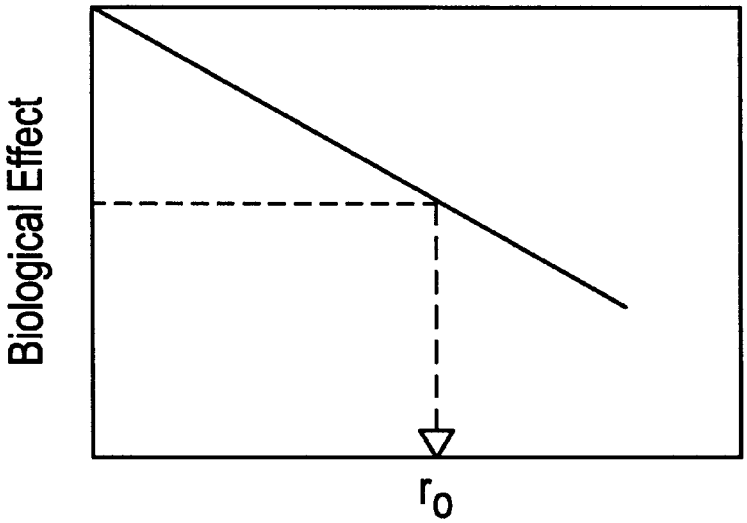
FIG. 4 is a hypothetical calibration curve for a given decrease half-time $T_d$ and increase half-time $T_i$.

FIG. 4 is a hypothetical calibration curve for a given decrease half-time $T_d$ and increase half-time $T_i$. The biological effect is given as a function of the extrapolated initial dose rate $r_o$ delivered by the $^{137}$Cs irradiator 12. To obtain the extrapolated initial dose rate for a given injected activity of a radiochemical having parameters $T_e$ and $T_{eu}$, the experimentally determined biological effect can be used in conjunction with the calibration curve as indicated by the dashed lines. With knowledge of $r_o$, $T_e$, and $T_{eu}$, one can readily calculate the total dose and dose rates at any given time postinjection.

Inasmuch as the relative biological effectiveness of $^{137}$Cs 662 keV gamma rays are the same as that of the beta particles emitted by radionuclides relevant to therapeutic nuclear medicine, e.g. $^{90}$Y, $^{131}$I, $^{32}$P, $^{186}$Re, such an irradiator system 10 also offers a unique opportunity to calibrate biological dosimeters for bone marrow dosimetry. Examples of potential biological dosimeters include survival of bone marrow subpopulations (e.g CFU-S, CFU-GM, etc.), induction of micronuclei in lymphocytes or reticulocytes, induction of chromosome aberrations in lymphocytes, and others. Calibration of a biological dosimeter to measure absorbed dose delivered to a target tissue by a given radiochemical can be accomplished generally by the following two steps:

1. Determine dose-rate kinetics in the target tissue for the radiochemical of interest. When the dose rate to the target tissue is principally due to activity within itself (i.e. self-dose rate), the increase and decrease half-times ($T_i$, $T_d$) are essentially equal to the experimentally determined effective uptake half-time $T_{eu}$ and effective clearance half-time $T_e$ of the radioactivity in the tissue. The assumption is generally valid when the primary contribution to the target tissue dose is from particulate radiations (e.g. $^{32}$P, $^{90}$Y, $^{212}$Bi).
2. Using the $T_d$ and $T_i$ established in Step 1, determine the response of the biological dosimeter as a function of extrapolated initial dose rate $r_o$ with the $^{137}$Cs irradiator 12 in system 10 (see FIG. 4).

Generally, two additional steps are required to utilize the calibrated biological dosimeter to ascertain the extrapolated initial dose rate received by the tissue following administration of a given activity of the radiochemical, as follows:

3. Obtain biological response of tissue following administration of a given activity of the radiochemical.
4. Using the calibration curve based on the response of the tissue to $^{137}$Cs gamma rays delivered with same dose rate pattern, i.e., $T_d$, $T_i$ (see FIG. 4), the extrapolated initial dose rate $r_o$ to the tissue can be extracted. With knowledge of $r_o$, $T_d$, and $T_i$, the dose rate and cumulated dose to the tissue can be calculated at any time t.

Calibration and implementation of biological dosimeters in this manner provide an effective means of accurately determining the absorbed dose and dose rate pattern received by the target tissue following administration of internal radionuclides that emit low-LET radiations. Biological dosimeters calibrated in this manner, however, are not able to provide information regarding dose and dose rate from internal radionuclides that emit high-LET radiations (e.g. alpha particles, Auger electrons). In these situations, the biological dosimeter would yield a quantity which is the product of the relative biological effectiveness (RBE) and the extrapolated initial dose rate $r_o$.

It should be noted that the irradiator system 10 described above delivers a whole-body dose and, as such, this system is particularly useful for biological dosimetry of sensitive tissues such as bone marrow and gonads.

The irradiator system 10 described above utilized a custom-designed $^{137}$Cs small-animal gamma irradiator 12 and a variable attenuator system 14, wherein the irradiator system 10 was capable of delivering chronic exposures of low-linear-energy-transfer (LET) radiation with any desired variable dose rate pattern encountered with internal radionuclides. Thus, the irradiator system 10 could be designed to irradiate animals with exponentially increasing and decreasing dose rate patterns that simulate those encountered during exposure from incorporated radionuclides. The irradiator system 10 can be used to calibrate biological dosimeters, which in turn can serve as an indirect experimental measurement of the absorbed dose. Such experimental measurements of the absorbed dose can be utilized to verify the calculated absorbed doses that are presently relied upon in internal radionuclide dosimetry.

In another embodiment of the present invention, an irradiator system is used in conjunction with a means for sensing radiation. The irradiator system may comprise an attenuator system which includes a liquid reservoir and an attenuation chamber, wherein the chamber and the reservoir are connected by tubing in a manner which allows transfer of liquid, such as mercury, therebetween. The attenuator system is disposed between an irradiator and the means for detecting or reading radiation, wherein the attenuation chamber is spaced apart from the radiation reading means to define an irradiation area. In operation, an object is placed in between the attenuation chamber and the reading means while the irradiator is activated. Radiation from the irradiator is filtered or attenuated by the attenuating means, wherein at least a part of the radiation which is not absorbed nor reflected from the attenuation chamber impinges upon the object. The object may in turn reflect or absorb part of the incident radiation, and part of the incident radiation may be transmitted through the object. The radiation reading means may be adapted to receive the radiation transmitted from the attenuation means and through and/or past the object. The radiation means may further filter or process its incident radiation. Thus, for example, radiation impinging upon the radiation reading means may be recorded and/or transmitted for further processing or viewing.

In one particular embodiment, the irradiator emits X-rays and the radiation reading means comprises a means for sensing X-rays or a means for exposing film or other recording device which is sensitive to X-rays.

In another particular embodiment, the present invention comprises a radiation examination apparatus which includes a radiation source, a detector for detecting radiation originating from the radiation source, and a radiation attenuator disposed between the radiation source and the detector. The attenuator comprises an attenuation chamber capable of containing a layer of a radiation-blocking liquid, an adjustment means for adjusting the thickness of the layer of the radiation-blocking liquid, including a reservoir capable of containing the liquid, and a siphon connection means for allowing the transfer of the liquid between the reservoir and the attenuation chamber. The adjustment means allows for the selective metering of the liquid layer thickness. The thickness of the layer in the attenuation chamber is a function of the difference in elevation between the top of the layer and the attenuation chamber and the top of the liquid in the reservoir. Changes in the thickness of the layer alter the radiation transmitted through the attenuation chamber, wherein the radiation originates from the radiation source. The detector is capable of detecting at least part of the attenuated radiation.

Figure 5:
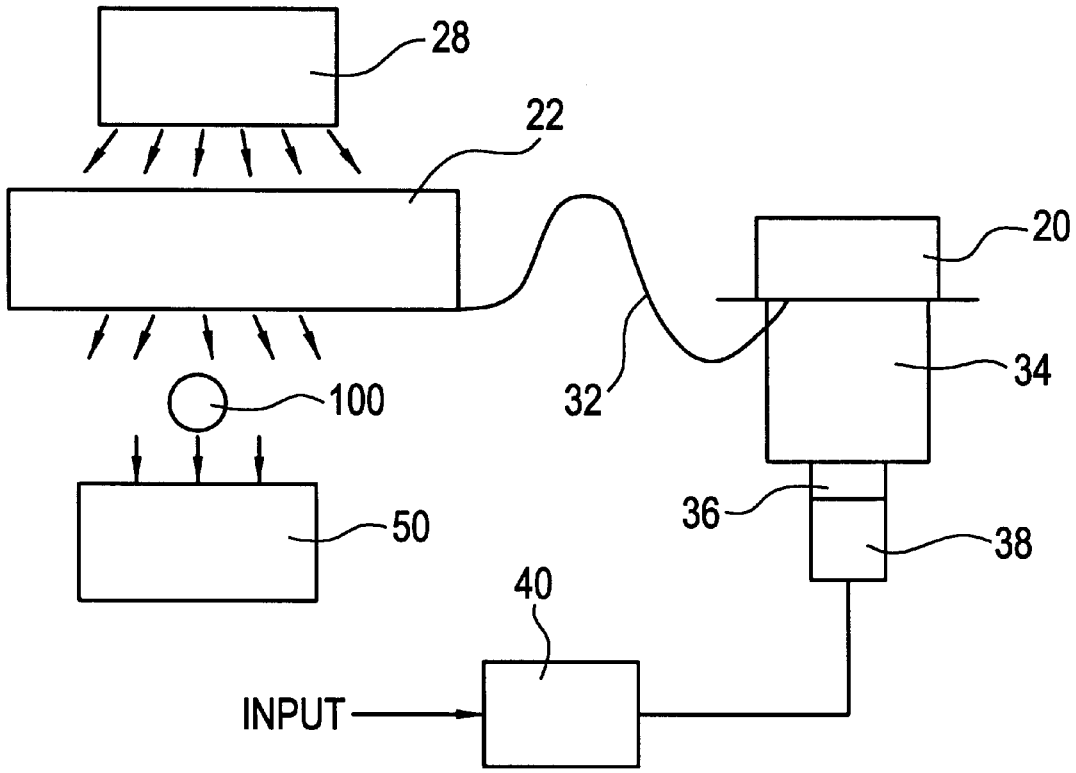
FIG. 5 is a schematic representation of a radiation examination apparatus according to the present invention.

FIG. 5 shows a schematic representation of a radiation examination apparatus according to one embodiment of the present invention. Structural elements which are similar to those found in FIG. 1 have been labeled with the same numerals. In addition, detector or reading means 50 is shown disposed at a spaced apart location from the attenuation means 22, wherein an object 100 to be irradiated or examined is placed or transported between the attenuation means 22 and the detector 50.

Figure 6:
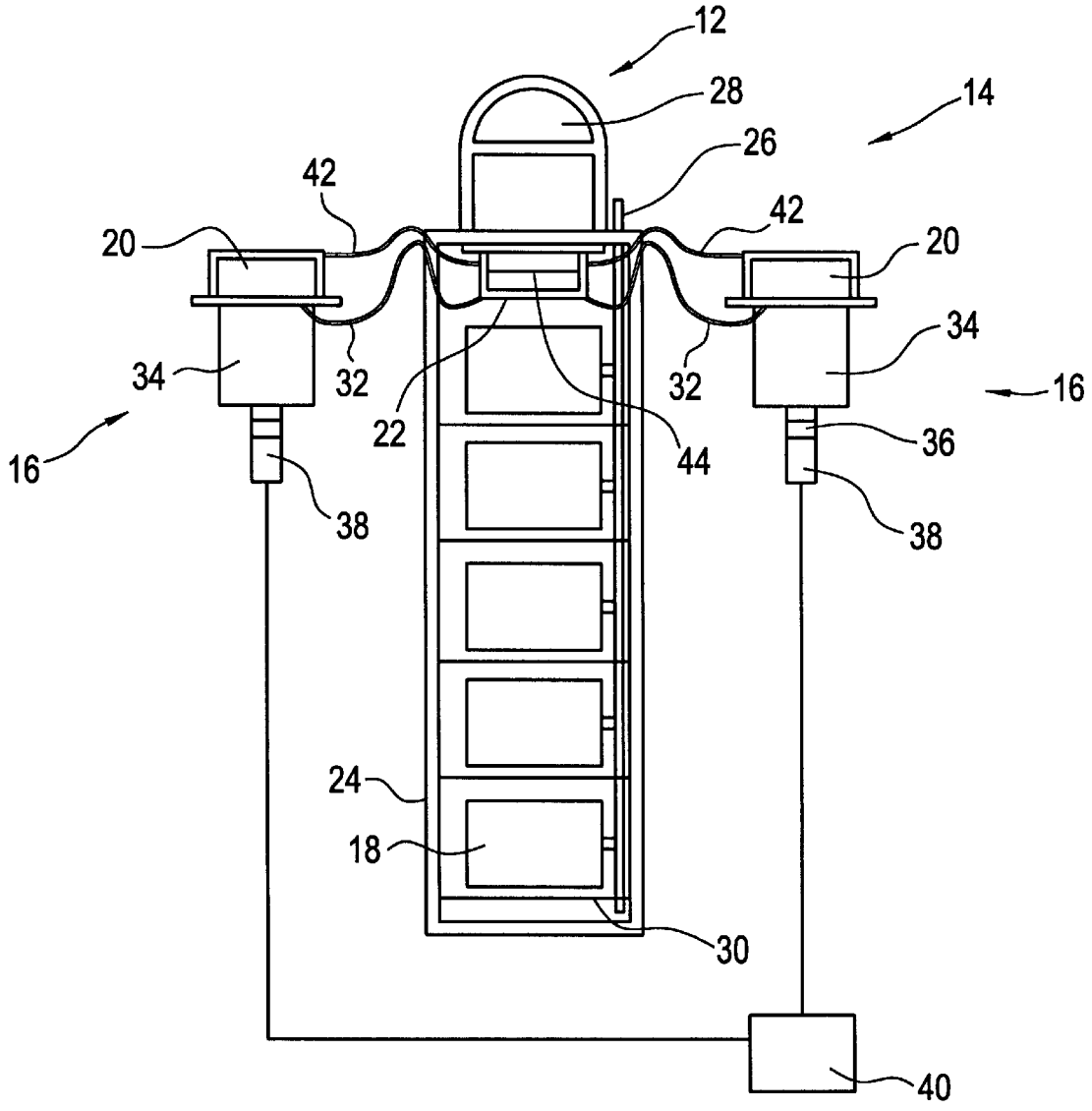
FIG. 6 is a schematic of another embodiment of an irradiator system according to the present invention showing an attenuation chamber divided into sub-chambers, each sub-chamber being connected to a respective reservoir.

FIG. 6 shows another embodiment of an irradiator system of the present invention, wherein structural elements similar to those of FIG. 1 have been labeled with the same numerals. The irradiator system 10 comprises an attenuation chamber 22 comprising at least one baffle 44 which separates the chamber 22 into two or more sub-chambers. The baffle prevents liquid flow between the sub-chambers. Each sub-chamber is supplied with a radiation-blocking liquid from its own respective reservoir 20 and motion control system 16. FIG. 6 shows all of the motion control systems 16 for each of the sub-chambers being connected to one control means 40, although each motion control system 16 may be provided with its own control means 40. Preferably the liquid levels in the sub-chambers are controlled in a coordinated fashion, although the liquid level in each sub-chamber may be controlled separately or independently of one or more of the liquid levels in the other sub-chambers. Thus, the radiation emitted from the radiation source may be selectively attenuated spatially, as well as temporally, at any given radiation dosing location or animal cage 18, or portion thereof. In one embodiment, for example, a first subchamber may contain a layer of a first radiation blocking liquid and a second subchamber may contain a second radiation blocking liquid, wherein the second liquid has a greater radiation blocking capability than the first liquid so that the first subchamber may be used for coarse adjustments in attenuation or delivery of radiation and the second subchamber can be used for fine adjustments thereof.

Figure 7:
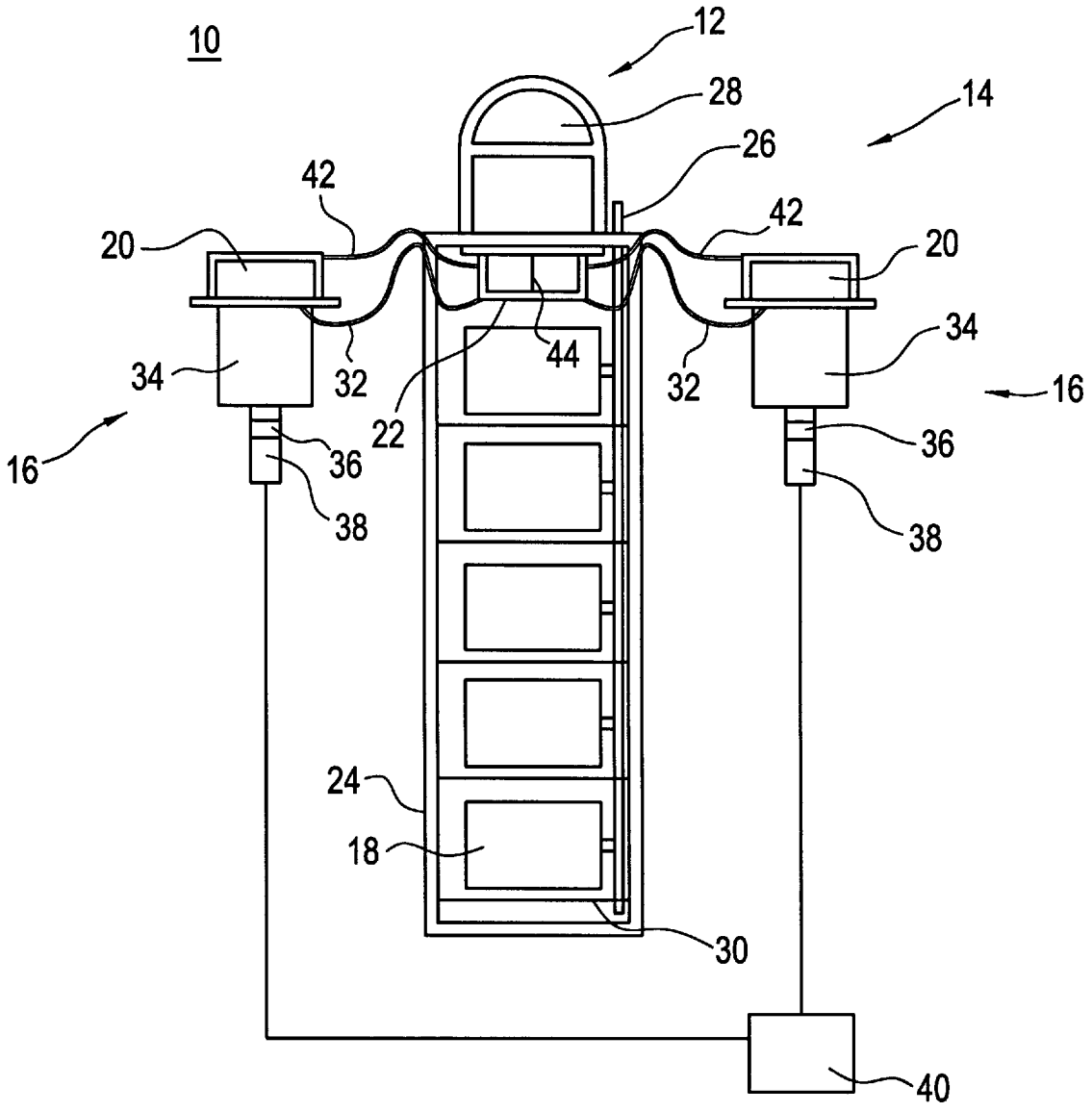
FIG. 7 is a schematic of yet another embodiment of an irradiator system according to the present invention showing an attenuation chamber divided into sub-chambers by at least one vertical baffle.

FIG. 7 shows yet another embodiment of an irradiator system according to the present invention similar to that shown in FIG. 6 but having at least one generally vertical oriented baffle. Such an embodiment could deliver spatially varied radiation doses in a horizontal plane, for example when different radiation blocking fluids are used and/or when different levels are maintained in different subchambers.

In still another embodiment, an irradiator system according to the present invention comprises an attenuation chamber 22 which includes at least one baffle for dividing the attenuation chamber into two or more sub-chambers wherein two or more sub-chambers are connected to a common reservoir.

In yet another particular embodiment, the present invention comprises a filter for use with an X-ray examination apparatus. The examination apparatus comprises an X-ray source and an X-ray detector for detecting X-rays originating from the X-ray source. The filter comprises an attenuation chamber capable of containing a layer of radiation-blocking liquid, an adjustment means for adjusting the thickness of the layer of the radiation-blocking liquid, a reservoir capable of containing the liquid, and a siphon connection means for allowing the transfer of the radiation-blocking liquid between the reservoir and the attenuation chamber. The thickness of the layer in the attenuation chamber is a function of the difference in elevation between the top of the layer in the attenuation chamber and the top of the liquid in the reservoir. Changes in the thickness of the layer alter the radiation transmitted through the attenuation chamber. Thus, the filter may be used to selectively meter the amount of radiation reaching an object which passes through the X-ray examination apparatus. The object may be subjected to a temporally varying dose of radiation. Alternately, or in addition, the object may be subject to one or more discrete levels of radiation.

In another particular embodiment, the present invention comprises a filter for use with an X-ray examination apparatus, such as that typically found in airports and other areas of security checking.

The present invention also contemplates an irradiating system which is used in therapeutic treatment applications, such as those associated with humans, animals, or plants. The present invention further contemplates attenuation and/or delivery of radiation in the preparation and/or treatment of food stuffs.

Most preferably, the adjustment means for selectively metering the thickness of a radiation-blocking layer comprises an attenuation chamber and a reservoir connected by a siphon means. It has been found that precise and repeatable control over the layer thickness can be achieved by such means or method. However, the adjustment means may alternately comprise a pump means for controlling the flows into and out of, and therefore the level of liquid in, the attenuation chamber, although precision, repeatability and/or reproducibility may not approach that achievable by the above-described embodiments. Furthermore, a pump means may be used to assist or enhance the control of the liquid level in the attenuation chamber, in conjunction with, or in parallel with, the siphon connection means. For example, a pump-assisted connection means between the attenuation chamber and the reservoir, which may include valve means and connections to the control means, may be provided in parallel with a siphon connection means to speed the addition and/or removal of the liquid from the attenuation chamber. For example, the pump means may be activated when rapid filling or emptying of the attenuation chamber is desired.

Furthermore, the attenuation chamber may be provided with one or more liquid level sensors to assist in the control of the liquid level and/or the calibration of the apparatus.

Preferably the attenuation chamber is adapted to possess a planar internal bottom surface which supports the radiation blocking liquid. The attenuation chamber may instead be provided with a non-planar bottom which would be necessary to achieve a desired dispersion or intensity of radiation. Preferably, the internal surfaces of the attenuation chamber that support the liquid are fixed or rigid.

The present invention may be used with either ionizing radiation, such as neutrons or protons, or nonionizing radiation, such as visible light, infrared or ultraviolet radiation. Typically a suitable radiation blocking liquid would be selected which is appropriate for the type of radiation to be attenuated and the desired range of attenuation. For example, a boron rich material may be used (instead of mercury) to attenuate neutron radiation. By way of another example, light intensity may be attenuated by an opaque liquid. By way of further example, aqueous solutions of a heavy metal salt, such as cesium acetate, may be used as an attenuating liquid.

The present invention may further comprise filtering and/or focusing radiation passing through the attenuation means.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. An irradiator apparatus for dispensing radiation onto an object, said apparatus comprising:

a radiation source adapted to direct radiation along a path toward said object;

at least one attenuation chamber located between said radiation source and said object and having a floor defining a surface area generally perpendicular to said path of said radiation;

the radiation-blocking liquid contained in said chamber having a volume sufficient to fill said floor and to form a layer of said radiation-blocking liquid;

said layer having a generally uniform thickness across said floor; and at least one adjustment means for selectively metering the thickness of said layer of said radiation-blocking liquid to thereby alter the radiation transmitted through said attenuation chamber; said adjustment means including a controller, said controller having software responsive to provide at least one dosage rate pattern for selection by a user and to execute said dosage rate pattern by causing said adjustment means to vary the thickness of said layer; wherein said adjustment means further comprises:

at least one reservoir capable of containing said radiation-blocking liquid; and at least one siphon connection means for allowing the transfer of said radiation-blocking liquid between said reservoir and said attenuation chamber;

wherein the thickness of said layer in said attenuation chamber varies in response to changes in elevation of said reservoir;

whereby an increase in the thickness of said layer causes a drop in the radiation transmitted through said attenuation chamber.

2. The apparatus of claim 1 wherein said radiation source generates gamma rays and said radiation blocking liquid is of the group consisting of mercury and water.

3. The apparatus of claim 1 wherein said radiation source generates neutrons and said radiation blocking liquid is of the group consisting of mercury and water.

4. The apparatus according to claim 2 wherein:

said attenuation chamber is positioned at a substantially fixed election; and said reservoir is vertically moveable relative to said attenuation chamber, whereby changes in the radiation dose rate transmitted through said attenuation chamber are caused by changes in the elevation of said reservoir.

5. The apparatus according to claim 4 wherein said controller further comprises means for controlling the movement of said reservoir, thereby providing control of the radiation transmitted through said attenuation chamber.

6. The apparatus according to claim 5 wherein said controller further comprises means for maintaining at least a minimum liquid thickness in said reservoir.

7. The apparatus according to claim 5 wherein said controller further comprises means for preventing the level of said liquid in said reservoir from rising above a maximum liquid height.

8. The apparatus according to claim 5 wherein said controller further comprises means for specifying a desired dose rate pattern.

9. The apparatus according to claim 8 wherein said dose rate pattern is an exponential dose rate pattern.

10. The apparatus according to claim 2 wherein said adjustment means further comprises a movable support means for supporting said reservoir and for adjusting the elevation of said reservoir relative to said attenuation chamber, including:

a platform; and drive means for vertically moving said platform.

11. The apparatus according to claim 10 wherein said drive means further comprises:

a shaft connected to said platform;

a stepper motor connected to said shaft responsive to motor control signals; and said controller being operatively connected to said stepper motor to generate and send said motor control signals.

12. The apparatus of claim 1 wherein said radiation source generates X-rays and said radiation blocking liquid is of the group consisting of mercury and water.

13. The apparatus according to claim 2 wherein said apparatus further comprises a mutual vent means connecting said attenuation chamber and reservoir above respective maximum liquid levels for allowing an equalization of gas pressure therebetween.

14. A method for delivering varying temporal radiation dose rates using an adjustable irradiator system, said system comprising at least one radiation source, at least one reservoir containing at least one radiation-blocking liquid, and at least one attenuation chamber connected to said reservoir by a siphon coupling and disposed in front of said radiation source said method comprising:

emitting a radiation beam from said radiation source to deliver a radiation dose;

selectively adjusting the elevation of said reservoir relative to said attenuation chamber; and allowing said radiation-blocking liquid to seek a common level in said attenuation chamber and in said reservoir;

thereby selectively adjusting the thickness of said radiation-blocking liquid in said attenuation chamber; whereby changes in the radiation dose rate transmitted through said attenuation chamber are a function of changes in the thickness of said radiation-blocking liquid in said attenuation chamber.

15. The method according to claim 14 further comprising selectively adjusting the elevation of said reservoir to cause an exponential rate of change in the radiation transmitted through said attenuation chamber.

16. The method according to claim 14 wherein a substantially constant rate of change in the level of said liquid in said reservoir causes a substantially constant rate of change in the level of said liquid in said attenuation chamber.

17. The method according to claim 14 wherein a substantially linear change in the thickness of said layer causes a substantially exponential change in the radiation dose rate transmitted through said attenuation chamber.

18. The method according to claim 14 further comprising maintaining a minimum liquid thickness in said attenuation chamber.

19. The method according to claim 14 further comprising preventing the level of said liquid in said attenuation chamber from rising above a maximum liquid level.

20. The method of claim 14 wherein said radiation source generates gamma rays and said radiation blocking liquid is selected from the group consisting of mercury and water.

21. The method of claim 14 wherein said radiation source generates neutrons and said radiation blocking liquid is selected from the group consisting of mercury and water.

22. The method of claim 14 wherein said radiation source generates X-rays and said radiation blocking liquid is of the group consisting of mercury and water.

23. A method for delivering at least one radiation dose rate using an adjustable irradiator system, said system comprising at least one radiation source, at least one reservoir containing at least one radiation-blocking liquid, and at least one attenuation chamber connected to said reservoir by a siphon coupling and disposed in front of said radiation source, said method comprising:

emitting a radiation beam from said radiation source to deliver a radiation dose;

selectively adjusting the elevation of said reservoir relative to said attenuation chamber; and allowing said radiation-blocking liquid to seek a common level in said attenuation chamber and in said reservoir;

thereby selectively adjusting the thickness of said radiation-blocking liquid in said attenuation chamber; whereby the radiation dose rate transmitted through said attenuation chamber is a function of the thickness of said radiation-blocking liquid in said attenuation chamber.

24. The method of claim 23 wherein said radiation source generates gamma rays and said radiation blocking liquid is selected from the group consisting of mercury and water.

25. The method of claim 23 wherein said radiation source generates neutrons and said radiation blocking liquid is selected from the group consisting of mercury and water.

26. An X- ray examination apparatus comprising:

an X-ray source;

an X-ray detector for detecting X-rays originating from said X-ray source;

a filter located between said X-ray source and said X-ray detector; said filter comprising:

a radiation-blocking liquid;

at least one attenuation chamber capable of containing a level layer of said radiation blocking liquid;

at least one adjustment means for uniformly adjusting the thickness of said layer of said radiation-blocking liquid;

at least one reservoir capable of containing said radiation-blocking liquid; and at least one siphon connection means for allowing the transfer of said radiation-blocking liquid between said reservoir and said attenuation chamber; wherein the thickness of said layer in said attenuation chamber varies in response to changes in elevation of said reservoir;

whereby changes in the thickness of said layer alter the radiation transmitted through said attenuation chamber.

27. A radiation examination apparatus comprising:

at least one radiation source for emitting radiation;

at least one detector for detecting radiation originating from said radiation source; and at least one radiation attenuator disposed between said radiation source and said detector, said attenuator comprising:

a radiation-blocking liquid;

at least one attenuation chamber containing a layer of said radiation-blocking liquid;

at least one adjustment means for adjusting the thickness of said layer of said radiation-blocking liquid;

at least one reservoir containing said radiation-blocking liquid and vertically movable relative to said attenuation chamber; and at least one siphon connection means for allowing the transfer of said radiation-blocking liquid between said reservoir and said attenuation chamber;

said adjustment means includes means for changing the elevation of said reservoir;

wherein the thickness of said layer in said attenuation chamber varies in response to changes in elevation of said reservoir;

whereby changes in the thickness of said layer alter the radiation transmitted through said attenuation chamber originating from said radiation source;

whereby said detector is capable of detecting at least part of the attenuated radiation.

28. The apparatus of claim 27 wherein said radiation source generates X-rays and said radiation blocking liquid is the group consisting of mercury and water.

29. The apparatus of claim 27 wherein said radiation source generates gamma rays and said radiation blocking liquid is selected from the group consisting of mercury and water.

30. The apparatus of claim 27 wherein said radiation source generates neutrons and said radiation blocking liquid is selected from the group consisting of mercury and water.

31. An automated method for administering at least one radiation dose rate using an adjustable irradiator system, said system comprising at least one radiation source, at least one reservoir containing at least one radiation-blocking liquid, and at least one attenuation chamber connected to said reservoir by a siphon coupling and disposed in front of said radiation source, said method comprising:

emitting a radiation beam from said radiation source to deliver a radiation dose;

automatically adjusting the elevation of said reservoir relative to said attenuation chamber, and allowing said radiation-blocking liquid to seek a common level in said attenuation chamber and in said reservoir;

thereby selectively adjusting the thickness of said radiation-blocking liquid in said attenuation chamber;

whereby the radiation dose rate transmitted through said attenuation chamber is a function of the thickness of said radiation-blocking liquid in said attenuation chamber.

32. The automated method according to claim 31 further comprising accepting at least one user input, wherein the elevation of said reservoir is automatically adjusted in response to said input.

33. The automated method according to claim 31 wherein said user input further comprises a temporal dose rate pattern.

34. The method of claim 31 wherein said radiation source generates X-rays and said radiation blocking liquid is selected from the group consisting of mercury and water.

35. The method of claim 31 wherein said radiation source generates gamma rays and said radiation blocking liquid is selected from the group consisting of mercury and water.

36. The method of claim 31 wherein said radiation source generates neutrons and said radiation blocking liquid is selected from the group consisting of mercury and water.

* * * * *